US006774084B2

(12) United States Patent
Loccufier et al.

(10) Patent No.: US 6,774,084 B2
(45) Date of Patent: Aug. 10, 2004

(54) THERMOGRAPHIC RECORDING MATERIAL WITH IMPROVED IMAGE TONE

(75) Inventors: Johan Loccufier, Zwijnaarde (BE); Geert Defieuw, Bonheiden (BE); Ivan Hoogmartens, Wilrijk (BE)

(73) Assignee: Agfa-Gevaert, Mortsel (BE)

( * ) Notice: Subject to any disclaimer, the term of this patent is extended or adjusted under 35 U.S.C. 154(b) by 281 days.

(21) Appl. No.: 10/106,172

(22) Filed: Mar. 26, 2002

(65) Prior Publication Data

US 2003/0064891 A1 Apr. 3, 2003

Related U.S. Application Data

(60) Provisional application No. 60/291,532, filed on May 16, 2001.

(30) Foreign Application Priority Data

Mar. 29, 2001 (EP) ..... 01000095

(51) Int. Cl.[7] ..... B41M 5/30
(52) U.S. Cl. ..... 503/201; 503/212
(58) Field of Search ..... 503/201, 212

(56) References Cited

U.S. PATENT DOCUMENTS 5,672,560 A 9/1997 Rush

FOREIGN PATENT DOCUMENTS

EP 0 903 625 A1 3/1999
EP 0 978 760 A1 2/2000

OTHER PUBLICATIONS

Search Report for EP 01 00 0095 dated Sep. 17, 2001.

*Primary Examiner*—Bruce Hess
(74) *Attorney, Agent, or Firm*—Leydig, Voit & Mayer, Ltd.

(57) ABSTRACT

A monosheet black and white substantially light-insensitive thermographic recording material comprising a thermosensitive element and a support, the thermosensitive element containing a substantially light-insensitive organic silver salt, a 1,2-dihydroxyphenyl-compound in thermal working relationship therewith and a binder, wherein said 1,2-dihydroxyphenyl-compound is represented by formula (I): $R^1SO_2R^2$, wherein $R^1$ is an optionally substituted aryl group and $R^2$ is selected from the group consisting of a 3,4,5-trihydroxyphenyl group, a 3-alkoxy-4,5-dihydroxyphenyl group and a 3-aryloxy-4,5-dihydroxyphenyl group; or said 1,2-dihydroxyphenyl-compound is represented by formula (II): $R^3COOR^4$, wherein $R^3$ is a 3-alkoxy-4,5-dihydroxyphenyl group or a 3-aryloxy-4,5-dihydroxyphenyl group; and $R^4$ is an alkyl group or an aryl group; and a thermographic recording process therefor.

8 Claims, No Drawings

THERMOGRAPHIC RECORDING MATERIAL WITH IMPROVED IMAGE TONE

This application claims the benefit of U.S. Provisional Application No. 60/291,532 filed May 16, 2001, which is incorporated by reference.

FIELD OF THE INVENTION

The present invention relates to thermographic recording materials whose prints have improved thermal development efficiency.

BACKGROUND OF THE INVENTION

Thermal imaging or thermography is a recording process wherein images are generated by the use of thermal energy. In direct thermal thermography a visible image pattern is formed by image-wise heating of a recording material.

EP-A 903 625 discloses a substantially light-insensitive black and white monosheet thermographic recording material is provided comprising a support and a thermosensitive element containing a substantially light-insensitive organic silver salt, a 1,2-dihydroxyphenyl-compound in thermal working relationship therewith and a binder, characterized in that the 1,2-dihydroxyphenyl-compound is represented by formula (I):

(I)

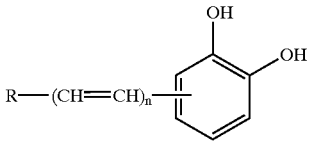

where R is —P(═O)$R^1R^2$, —$SO_xR^3$, —CN, —$NO_2$ or —$CR^4$═$NR^5$ when n is 0; R is —P(═O)$R^1R^2$, —$SO_xR^3$, —CN, —$NO_2$, —$CR^4$═$NR^5$ or —$COR^6$ when n is a integer; $R^1$ and $R^2$ are independently an alkyl, a substituted alkyl, an aryl, a substituted aryl group, an alkoxy, a substituted alkoxy, an aryloxy, a substituted aryloxy, a hydroxy group, an amino group or a substituted amino group; $R^3$ is an alkyl, a substituted alkyl, an aryl, a substituted aryl, an amino or a substituted amino group; $R^4$is an alkyl, a substituted alkyl, an aryl or a substituted aryl group or hydrogen; $R^5$ is an alkyl, a substituted alkyl, an aryl, a substituted aryl, a hydroxy, an alkoxy, an aryloxy, an acyl, an amino or a substituted amino group; $R^6$ is an alkyl, a substituted alkyl, an aryl, a substituted aryl, an alkoxy, a substituted alkoxy, an aryloxy, a substituted aryloxy, a hydroxy, an amino or a substituted amino group or hydrogen; x is 1, 2 or 3; and the benzene ring of the 1,2-dihydroxyphenyl-compound represented by the formula (I) may be further substituted.

EP-A 978 760 discloses a substantially light-insensitive black and white monosheet thermographic recording material comprising a support and a thermosensitive element containing a substantially light-insensitive organic silver salt, a 1,2-dihydroxyphenyl-compound in thermal working relationship therewith and a binder, characterized in that the 1,2-dihydroxyphenyl-compound is represented by formula (I):

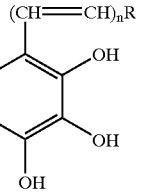

where n is 0 or 1; R is —(C═O)$R^1$, —(C═O)$NR^1R^2$, —CN, —$SO_3R^2$, —$SO_2R^2$, —$SOR^2$, —$SO_2NR^2R^3$ or —$PO_3R^2R^3$; $R^1$ is H or a substituted or unsubstituted alkyl group with 12 or less carbon atoms; and $R^2$ and $R^3$ are independently H or an alkyl, a substituted alkyl, an aryl or a substituted aryl group; and $R^1$ and $R^2$ together can provide the atoms to close a carbocyclic or heterocyclic ring; and $R^2$ and $R^3$ together can represent the atoms to close a carbocyclic or heterocyclic ring Prior art thermographic recording materials whose prints exhibit acceptable archivability exhibit unsatisfactory $D_{max}$/(silver behenate) coverage ratios i.e. the quantity of silver behenate required to obtain a given $D_{max}$ is too high. A means is needed to increase the $D_{max}$/(silver behenate) coverage ratio without deterioration in print archivability.

ASPECTS OF THE INVENTION

It is therefore an aspect of the present invention to provide improved reducing agents for substantially light-insensitive black and white thermographic recording materials with improved thermal development efficiency i.e. improved $D_{max}$/(organic silver salt coverage) ratios without significant deterioration in archivability of the prints obtained therewith.

Further aspects and advantages of the invention will become apparent from the description hereinafter.

SUMMARY OF THE INVENTION

Surprisingly it has been found that particular types of novel reducing agents produce an improvement in thermal development efficiency in thermographic recording materials as shown by an increase in the $D_{max}$/(organic silver salt coverage) ratio without significant deterioration in archivability of the prints thereby obtained.

The above mentioned aspects are realized by providing a monosheet black and white substantially light-insensitive thermographic recording material comprising a thermosensitive element and a support, the thermosensitive element containing a substantially light-insensitive organic silver salt, a 1,2-dihydroxyphenyl-compound in thermal working relationship therewith is and a binder, wherein said 1,2-dihydroxyphenyl-compound is represented by formula (I): $R^1SO_2R^2$, wherein $R^1$ is an optionally substituted aryl group and $R^2$ is selected from the group consisting of a 3,4,5-trihydroxyphenyl group, a 3-alkoxy-4,5-dihydroxyphenyl group and a 3-aryloxy-4,5-dihydroxyphenyl group; or said 1,2-dihydroxyphenyl-compound is represented by formula (II): $R^3COOR^4$, wherein $R^3$ is a 3-alkoxy-4,5-dihydroxyphenyl group or a 3-aryloxy-4,5-dihydroxyphenyl group; and R is an alkyl group or an aryl group. Combinations of compounds according formula (I) or formula (II) may also be used that on heating become reactive partners in the reduction of the substantially light-insensitive organic silver salt.

The above mentioned aspects are also realized by providing a thermographic recording process for a monosheet black and white substantially light-insensitive thermographic recording material according to any of the preceding descriptions comprising the steps of: (i) providing the thermographic recording material; (ii) bringing the thermographic recording material into the proximity of a heat source; (iii) applying heat imagewise from the heat source to the thermographic recording material; and (iv) removing the thermographic recording material from the proximity of the heat source.

Several embodiments are disclosed in the description set forth herein.

DETAILED DESCRIPTION OF THE INVENTION

According to a first embodiment of the thermographic recording process, according to the present invention, the heat source is a thermal head.

According to a second embodiment of the thermographic recording process according to the present invention, the heat source is a thin film thermal head.

Definitions

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethylpropyl, 2,2-dimethylpropyl and 2-methyl-butyl etc.

By substantially light-insensitive is meant not intentionally light sensitive.

Heating in association with the expression a substantially water-free condition as used herein, means heating at a temperature of 80 to 250° C. The term "substantially water-free condition" as used herein means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

Compounds According to Formula (I)

According to a first embodiment of the substantially light-insensitive thermographic recording material of the present invention, $R^1$ in the compound according to formula (I) is a phenyl group optionally substituted with a chlorine or a bromine atom or an alkyl, an aryl, an alkoxy, an aryloxy, a cyano, or a nitro group.

According to a second embodiment of the substantially light-insensitive thermographic recording material of the present invention, the alkoxy group in the 3-alkoxy-4,5-dihydroxyphenyl group option of $R^2$ is a methoxy, an ethoxy, a n-propoxy, an isopropoxy, a n-butoxy or a t-butoxy group.

Suitable compounds according to formula (I) for use in the thermographic recording materials of the present invention are:

R01

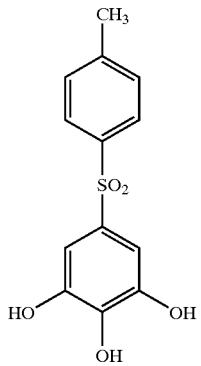

4-methyl-3',4',5'-trihydroxy-diphenylsulphone

R02

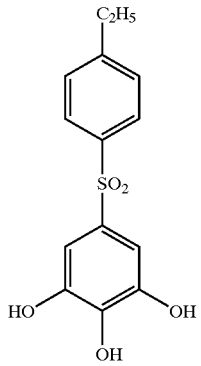

4-ethyl-3',4',5'-trihydroxy-diphenylsulphone

-continued
| | | |
|---|---|---|
| R03 | 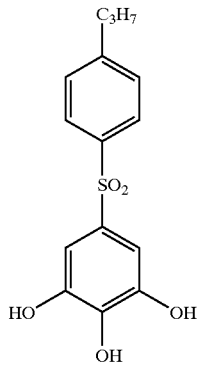 | 4-n-propyl-3',4',5'-trihydroxy-diphenylsulphone |
| R04 | 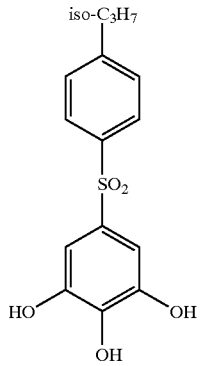 | 4-isopropyl-3',4',5'-trihydroxy-diphenylsulphone |
| R05 | 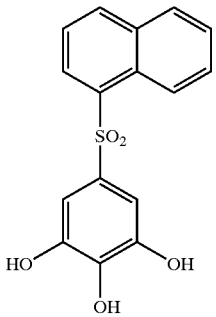 | 3,4,5-trihydroxyphenyl-1-naphthyl-sulphone |
| R06 | 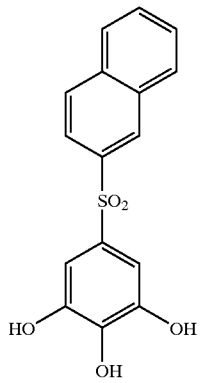 | 3,4,5-trihydroxyphenyl-2-naphthyl-sulphone |

-continued
| | | |
|---|---|---|
| R07 | 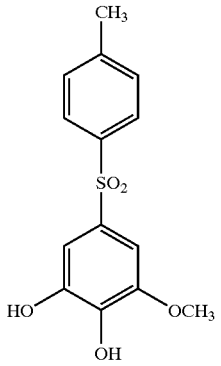 | 4-methyl-3'-methoxy-4',5'-dihydroxy-diphenylsulphone |
| R08 | 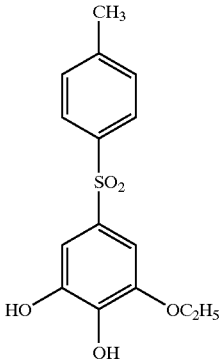 | 4-methyl-3'-ethoxy-4',5'-dihydroxy-diphenylsulphone |
| R09 | 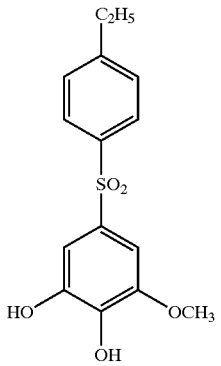 | 4-ethyl-3'-methoxy-4',5'-dihydroxy-diphenylsulphone |
| R10 | 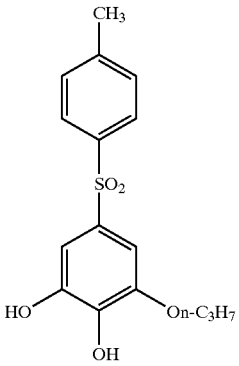 | 4-methyl-3'-n-propoxy-4',5'-dihydroxy-diphenylsulphone |

-continued

| | | |
|---|---|---|
| R11 | 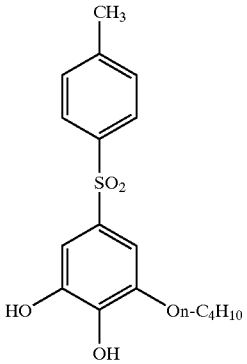 | 4-methyl-3'-n-butoxy-4',5'-dihydroxy-diphenylsulphone |
| R12 | 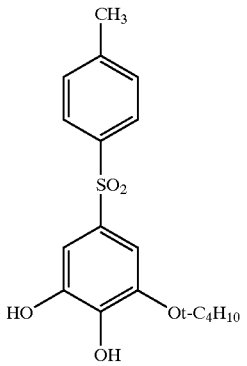 | 4-methyl-3'-t-butoxy-4',5'-dihydroxy-diphenylsulphone |
| | 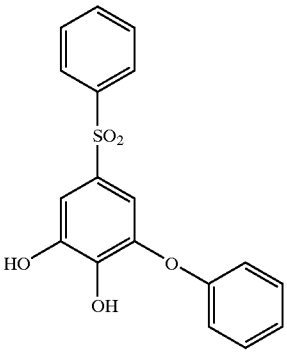 | 3,4-dihydroxy-5-phenoxy-diphenylsulphone |

Synthesis of Compounds According to Formula (I)

There are several different options for the synthesis of 3,4,5-trihydroxy and 3-alkoxy-4,5-dihydroxybenzene sulfones, starting from readily available compounds. Oxidative coupling of sulphinic acids to the corresponding polyhydroxybenzene is the most elegant synthetic approach. This approach has been reported in the literature in Z. Naturforsch., B: Anorg. Chem., Org. Chem., 38B(6), 752–60 (1983); and J. Chem. Res., Synop. 12, 382–3 (1981). An overview on the synthesis of the required sulphinic acids can be found in U. Zoller in The Chemistry of Sulphinic Acids, Esters and their Derivatives, editor Saul Patai, John Wiley and Sons 1990, chapter 7. The most important synthetic approach toward sulphinic acids is the reduction of the corresponding sulfochlorides by e.g. zinc or sulfite. The required polyhydroxybenzenes are commercially available or easily accessable by conventional synthetic methods.

It is obvious that a wide variety of compounds can be prepared using this synthetic strategy. Alternative strategies, using protected polyhydroxybenzenes, in combination with oxidation of arylthioethers, followed by deprotection of the intermediate protected sulphones, are also possible. However, it is obvious that these pathways are laborious in comparison with oxidative coupling of sulphinic acids.

The structures of the compounds synthesized according to formula (I) were confirmed by $^1$H-NMR-spectroscopy.

Compounds According to Formula (II)

According to a third embodiment of the substantially light-insensitive thermographic recording material of the present invention, the alkoxy group in the 3-alkoxy-4,5-dihydroxyphenyl group option of $R^3$ is a methoxy, an ethoxy, a n-propoxy, an isopropoxy, a n-butoxy, a t-butoxy or a n-octoxy group.

According to a fourth embodiment of the substantially light-insensitive thermographic recording material of the present invention, the alkoxy group in the 3-aryloxy-4,5-dihydroxyphenyl group option of $R^3$ is substituted with an alkenyl, an ether or a sulfoaryl group.

Suitable compounds according to formula (II) for use in the thermographic recording materials of the present invention are:

| | | |
|---|---|---|
| R21 | 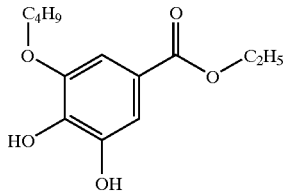 | ethyl 3-n-butoxy-4,5-dihydroxybenzoate |
| R22 | 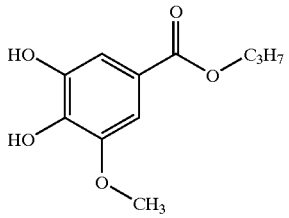 | methyl 3-n-propoxy-4,5-dihydroxybenzoate |
| R23 | 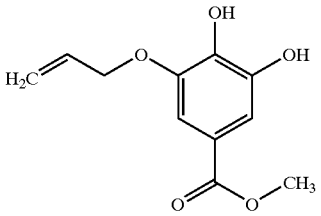 | methyl 3-allyloxy-4,5-dihydroxybenzoate |
| R24 | 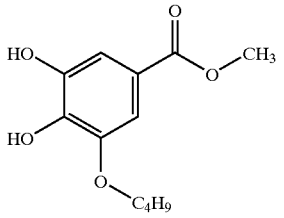 | methyl 3-n-butoxy-4,5-dihydroxybenzoate |
| R25 | 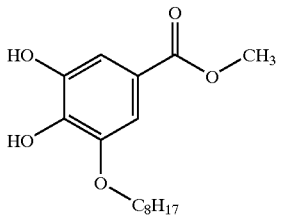 | methyl 3-n-octoxy-4,5-dihydroxybenzoate |
| R26 | 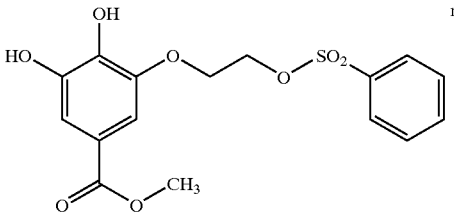 | methyl 3-[2'-(phenylsulfo)]ethoxy-4,5-dihydroxybenzoate |
| R27 | 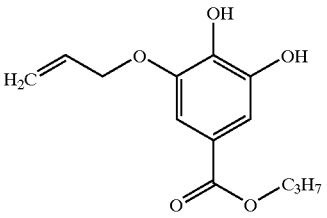 | n-propyl 3-allyloxy-4,5-dihydroxybenzoate |

-continued

| | | |
|---|---|---|
| R28 | 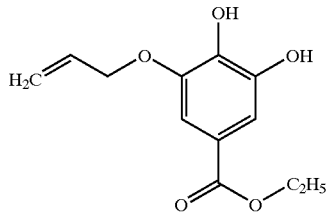 | ethyl 3-allyloxy-4,5-dihydroxybenzoate |
| R29 | 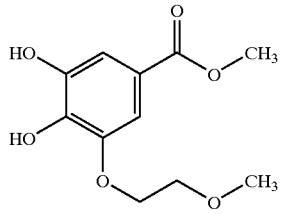 | methyl 3-(2'-methoxy)ethoxy-4,5-dihydroxybenzoate |
| R30 | 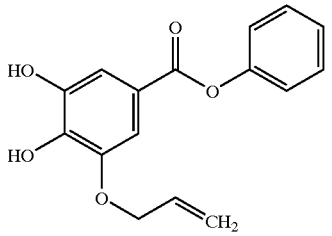 | phenyl 3-allyloxy-4,5-dihydroxybenzoate |
| R31 | 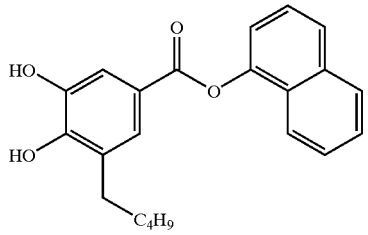 | 1-naphthyl 3-n-butoxy-4,5-dihydroxybenzoate |

Synthesis of the Compounds According to Formula (II)

Compounds according to formula (II) are readily accessible from commercially available compounds, using well documented synthetic strategies. Typical examples of the synthesis of these compounds can be found in J. Prakt. Chem. (Weinheim, Ger.), 341(7), 657–661 (1999); J. Org. Chem., 64(16), 5794–5803 (1999); J. Org. Chem., 61(19), 6656–6665 (1996); Tetrahedron Lett., 3(48), 7741–4 (1993); Eur. Pat. Appl., 491600 (1992); and Can. J. Chem., 65(10), 2390–6 (1987). From this literature, it is clear that a wide variety in substituents are synthetically accessible.

The structures of the compounds synthesized according to formula (II) were confirmed by $^{1}$H-NMR-spectroscopy.

Thermosensitive Element

The thermosensitive element as used herein is that element which contains all the ingredients which contribute to image formation. According to the present invention the thermosensitive element, contains a substantially light-insensitive organic silver salt, a 1,2-dihydroxyphenyl-compound as a reducing agent therefor in thermal working relationship therewith and a binder. The element may comprise a layer system in which the above-mentioned ingredients may be dispersed in different layers, with the proviso that the substantially light-insensitive organic silver salt is in reactive association with the reducing agent i.e. during the thermal development process the reducing agent must be present in such a way that it is able to diffuse to the particles of substantially light-insensitive organic silver salt so that reduction to silver can occur.

Organic Silver Salt

According to a fifth embodiment of the substantially light-insensitive thermographic recording material of the present invention, the organic silver salt is not a double organic salt containing a silver cation associated with a second cation e.g. magnesium or iron ions.

According to a sixth embodiment of the substantially light-insensitive thermographic recording material of the present invention, the organic silver salt is a substantially light-insensitive silver salt of an organic carboxylic acid.

According to a seventh embodiment of the substantially light-insensitive thermographic recording material of the present invention, the organic silver salt is a substantially light-insensitive silver salt of an aliphatic carboxylic acids known as a fatty acid, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salt of an organic carboxylic acids may also be used in the present invention, as disclosed in EP-A 964 300.

Organic silver salts may be dispersed by standard dispersion techniques e.g. using ball mills, bead mills, microfluidizers, ultrasonic apparatuses, rotor stator mixers etc. have been found to be useful in this regard. Mixtures of organic silver salt dispersions produced by different techniques may also be used to obtain the desired thermographic properties e.g. of coarser and a more finely ground dispersions of organic silver salts.

Auxiliary Reducing Agent

Combinations of compounds according formula (I) or formula (II) with a further reducing agent may also be used that on heating become reactive partners in the reduction of the substantially light-insensitive organic silver salt.

According to an eighth embodiment of the substantially light-insensitive thermographic recording material of the present invention, the thermosensitive element contains a reducing agent in addition to a compound according to formula (I) or formula (II).

According to a ninth embodiment of the substantially light-insensitive thermographic recording material of the present invention, the thermosensitive element further contains at least one reducing agent disclosed in EP-B 692 733 or a reducing agent disclosed in EP-A 903 625.

According to a tenth embodiment of the substantially light-insensitive thermographic recording material of the present invention, the thermosensitive element further contains at least one reducing agent selected from the group consisting of 3,4-dihydroxybenzoate alkyl and aryl esters (such as ethyl 3,4-dihydroxybenzoate or n-butyl 3,4-dihydroxybenzoate), 3,4-dihydroxybenzophenone, 3,4-dihydroxy-acetophenone and 3,4-dihydroxybenzonitrile.

Binder of the Thermosensitive Element

The film-forming binder of the thermosensitive element may be all kinds of natural, modified natural or synthetic resins or mixtures of such resins, in which the substantially light-insensitive organic silver salt can be dispersed homogeneously either in aqueous or solvent media: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

According to a tenth embodiment of the substantially light-insensitive thermographic recording material of the present invention, the thermosensitive element contains a binder which does not contain additives or impurities which adversely affect the thermographic properties of the thermographic recording materials in which they are used.

Toning Agent

According to an eleventh embodiment of the substantially light-insensitive thermographic recording material of the present invention, the thermosensitive element further contains a so-called toning agent organic silver salt in order to obtain a neutral black image tone in the higher densities and neutral grey in the lower densities.

Suitable toning agents are described in U.S. Pat. Nos. 3,074,809, 3,446,648 and 3,844,797 and 4,082,901. Other particularly useful toning agents are the heterocyclic toning compounds of the benzoxazine dione or naphthoxazine dione type as disclosed in GB 1,439,478, U.S. Pat. Nos. 3,951,660 and 5,599,647.

According to a twelfth embodiment of the substantially light-insensitive thermographic recording material of the present invention, the thermosensitive element further contains one or more toning agents selected from the group consisting of phthalazinone, benzo[e][1,3]oxazine-2,4-dione, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

Stabilizers

Stabilizers may be incorporated into the substantially light-insensitive thermographic recording materials of the present invention in order to obtain improved shelf-life and reduced fogging.

According to a thirteenth embodiment of the substantially light-insensitive thermographic recording material of the present invention, the thermosensitive element further contains at least one stabilizer selected from the group consisting of benzotriazole; substituted benzotriazoles; tetrazoles; mercaptotetrazoles, such as 1-phenyl-5-mercapto-tetrazole; and aromatic polycarboxylic acids, such as ortho-phthalic acid, 3-nitro-phthalic acid, tetrachlorophthalic acid, mellitic acid, pyromellitic acid and trimellitic acid, and anhydrides thereof.

Polycarboxylic Acids and Anhydrides Thereof

According to the substantially light-insensitive thermographic recording material of the present invention the thermosensitive element may comprise in addition at least one optionally substituted aliphatic (saturated as well as unsaturated aliphatic and also cycloaliphatic) polycarboxylic acid and/or anhydride thereof in a molar percentage of at least 15 with respect to all the organic silver salt(s) present and in thermal working relationship therewith. The polycarboxylic acid may be used in anhydride form or partially esterified form on the condition that at least two free carboxylic acids remain or are available in the heat recording step.

According to a fourteenth embodiment of the substantially light-insensitive thermographic recording material of the present invention, the thermosensitive element further contains glutaric acid.

Surfactants and Dispersion Agents

Surfactants and dispersants aid the dispersion of ingredients or reactants which are insoluble in the particular dispersion medium. The thermographic recording materials of the present invention may contain one or more surfactants, which may be anionic, non-ionic or cationic surfactants and/or one or more dispersants.

Other Additives

The recording material may contain in addition to the ingredients mentioned above other additives such as levelling agents e.g. BAYSILON™ MA (from BAYER AG, GERMANY).

Support

The support for the thermosensitive element according to the present invention may be transparent, translucent or opaque and is a thin flexible carrier made of transparent resin film, e.g. made of a cellulose ester, cellulose triacetate, polypropylene, polycarbonate or polyester, e.g. polyethylene terephthalate.

The support may be in sheet, ribbon or web form and subbed if need be to improve the adherence to the thereon coated thermosensitive element. It may be pigmented with a blue pigment as so-called blue-base. One or more backing layers may be provided to control physical properties such as curl and static.

Protective Layer

According to a fifteenth embodiment of the substantially light-insensitive thermographic recording material of the present invention, the thermosensitive element is provided with a protective layer to avoid local deformation of the thermosensitive element and to improve resistance against abrasion.

According to a sixteenth embodiment of the substantially light-insensitive thermographic recording material of the present invention, the thermosensitive element is provided with a protective layer comprising a binder, which may be solvent-soluble, solvent-dispersible, water-soluble or water-dispersible.

According to a seventeenth embodiment of the substantially light-insensitive thermographic recording material of the present invention, the thermosensitive element is provided with a protective layer comprising solvent-soluble polycarbonates as binders as described in EP-A 614 769.

According to a eighteenth embodiment of the substantially light-insensitive thermographic recording material of the present invention, the thermosensitive element is provided with a protective layer comprising a water-soluble or water-dispersible binder, as coating can be performed from an aqueous composition and mixing of the protective layer with the immediate underlayer can be avoided by using a solvent-soluble or solvent-dispersible binder in the immediate underlayer. The protective layer according to the present invention may be crosslinked. Crosslinking can be achieved by using crosslinking agents such as described in WO 95/12495. Solid or liquid lubricants or combinations thereof are suitable for improving the slip characteristics of the thermographic recording materials according to the present invention.

According to an nineteenth embodiment of the substantially light-insensitive thermographic recording material of the present invention, the thermosensitive element is provided with a protective layer comprising a solid thermomeltable lubricant such as those described in WO 94/11199.

The protective layer of the thermographic recording material according to the present invention may comprise a matting agent. According to a twentieth embodiment of the substantially light-insensitive thermographic recording material of the present invention, the thermosensitive element is provided with a protective layer comprising a matting agent such as described in WO 94/11198, e.g. talc particles, and optionally protrude from the protective layer.

Coating

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Thermographic Processing

Thermographic imaging is carried out by the image-wise application of heat either in analogue fashion by direct exposure through an image or by reflection from an image, or in digital fashion pixel by pixel either by using an infra-red heat source, for example with a Nd-YAG laser or other infra-red laser, with a substantially light-insensitive thermographic material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

Industrial Application

Thermographic imaging can be used for the production of reflection type prints and transparencies, in particular for use in the medical diagnostic field in which black-imaged transparencies are widely used in inspection techniques operating with a light box.

Illustrative Synthesis of Compounds According to Formula (I)

To illustrate the general synthesis approach adopted in the synthesis of compounds according to formula (I), the synthesis of 3-methoxy-4,5-dihydroxy-1-tolylsulphonylbenzene is described in detail.

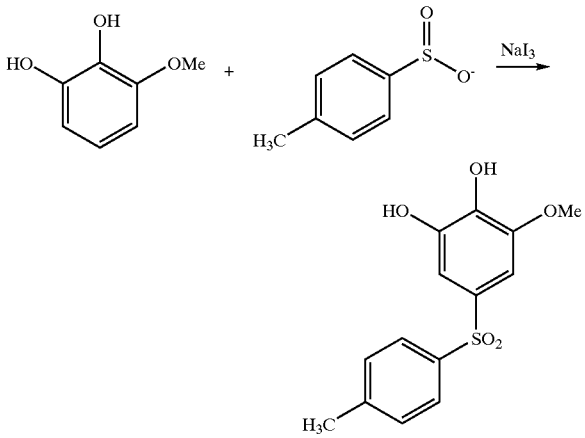

9,8 g (0.07 mol) 1-methoxy-2,3-dihydroxybenzene was dissolved in 67 ml of an aqueous solution of 10.7 g $NaOAc.3H_2O$. 12.7 g (0.07 mol) tolylsulphinic acid sodium salt was added. A solution of 10.5 g (0.07 mol) of sodium iodide and 17.8 g (0.07 mol) of iodine in a 100 mL of deionized water was then added slowly to this mixture, after which the resulting reaction mixture was stirred for an additional hour and left overnight. The crude diarylsulphone precipitated from the medium as a grey brown solid and was isolated by filtration and purified by dissolving it in methanol and treating the solution twice with activated carbon. The methanol was then removed under reduced pressure and the solid residue recrystallized from 250 mL of acetonitrile/water 3/2. The yield was 10.2 g (49.5%) and its structure was confirmed by $^1$H-NMR-spectroscopy.

Illustrative Synthesis of Compounds According to Formula (II)

To illustrate the general synthetic approach adopted, the synthesis of butoxy-ethylgallate is described in more detail.

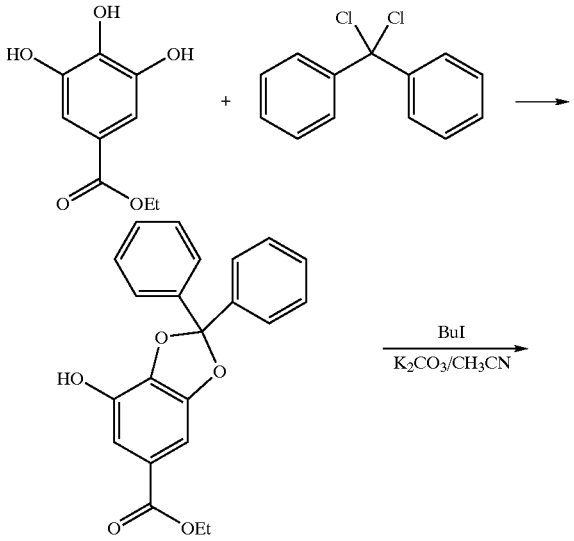

-continued

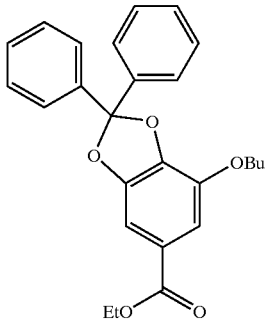

119 g (0.6 mol) ethylgallate and 115 mL (142.2 g, 0.6 mol) dichloro diphenylmethane was heated to 175° C. for 5 hours. After cooling to room temperature, 900 mL acetonitrile was added and the solidified mixture dissolved. 97 g potassium carbonate (0.7 mol) was then added and after adding 80 mL (129 g, 0.7 mol) of n-butyl iodide, the mixture was refluxed for 4 hours. The solvent was then removed under reduced pressure and the residue extracted with methylene chloride. After evaporating the methylene chloride from the methylene chloride extract, the intermediate protected gallate was used without further purfication (yield : 189.5 g 75%).

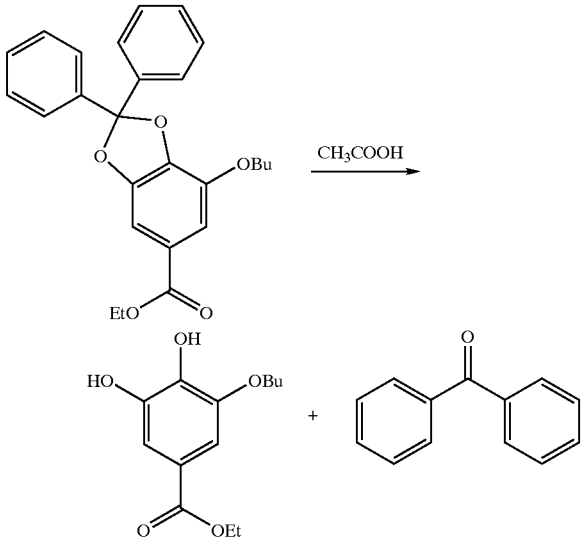

The crude intermediate was then dissolved in 1335 mL of acetic acid and 330 mL water and was refluxed for 7 hours. The solvent was then removed under reduced pressure and the oily residue purified by preparative column chromatography (eluent:93 $CH_2Cl_2$/7 EtOAc 7) to remove benzophenone. The purified product was treated again with methyl tertiary butylether and hexane. (yield: 114 g, 75%) and its structure confirmed by $^1$H-NMR-spectroscopy The invention is illustrated hereinafter by way of comparative examples and invention examples. The percentages and ratios given in these examples are by weight unless otherwise indicated. The ingredients used in the invention and comparative examples, are:

Thermosensitive Element:

organic silver salt:

AgB=silver behenate;

the reducing agent:

CR01=ethyl 3,4-dihydroxybenzoate (according to EP-A 692733);

CR02=methyl 3,4-dihydroxyphenylsulphone (according to EP-A 903625);

CR03=3,4-dihydroxybenzonitrile (according to EP-A 903625);

binders:

BL5HP=S-LEC BL5HP, a polyvinylbutyral from Sekusui;

the toning agents:

T01=benzo[e][1,3]oxazine-2,4-dione;

T02=7-(ethylcarbonato)-benzo[e][1,3]oxazine-2,4-dione;

the stabilizers:

S01=glutaric acid;

S02=tetrachlorophthalic acid anhydride;

S03=benzotriazole.

COMPARATIVE EXAMPLES 1 TO 3 AND INVENTION EXAMPLES 1 TO 3

Preparation of the Thermosensitive Element

The thermosensitive elements of COMPARATIVE EXAMPLES 1 to 3 and INVENTION EXAMPLES 1 to 3 were produced by coating a dispersion with the following ingredients in 2-butanone onto a subbed 168 μm thick blue-pigmented polyethylene terephthalate support to produce layers with the compositions given in Table 1.

TABLE 1

| | | Reducing agent | | | T01 | T02 | S01 | S02 | S03 | |
|---|---|---|---|---|---|---|---|---|---|---|
| | AgB [g/m²] | type | mol % vs AgB | BL5HP [g/m²] | mol % vs AgB | mol % vs AgB | mol % vs AgB | mol % vs AgB | mol % vs AgB | Oil [g/m²] |
| Invention Example nr. | | | | | | | | | | |
| 1 | 3.29 | R01 | 50 | 13.16 | 15 | 5 | 24 | 4.91 | 9.84 | 0.03 |
| 2 | 4.13 | R07 | 50 | 16.52 | 15 | 5 | 24 | 4.91 | 9.84 | 0.03 |
| 3 | 3.58 | R21 | 50 | 14.32 | 15 | 5 | 24 | 4.91 | 9.84 | 0.03 |
| Comparative Example nr. | | | | | | | | | | |
| 1 | 4.68 | CR01 | 50 | 18.72 | 15 | 5 | 24 | 4.91 | 9.84 | 0.03 |
| 2 | 3.42 | CR02 | 50 | 13.68 | 15 | 5 | 24 | 4.91 | 9.84 | 0.03 |
| 3 | 3.42 | CR03 | 50 | 13.68 | 15 | 5 | 24 | 4.91 | 9.84 | 0.03 |

Protective Layer

The thermosensitive elements of the thermographic recording materials of COMPARATIVE EXAMPLES 1 to 3 and INVENTION EXAMPLES 1 to 3 were then coated with an aqueous composition with the following composition:

| | |
|---|---|
| polyvinylalcohol (Polyviol ™ WX 48 20 from Wacker Chemie): | 2.1 g/m² |
| colloidal silica (Levasil ™ VP AC 4055 from Bayer AG, a 15% aqueous dispersion of colloidal silica): | 1.05 g/m² |
| Ultravon 198 W (dispersion agent from Ciba Geigy) converted into acid form by passing through an ion exchange column: | 0.075 g/m² |
| silica (Syloid ™ 72 from Grace) | 0.09 g/m² |
| mono[isotridecyl polyglycolether (3 EO)] phosphate Servoxyl ™ VPDZ 3/100 from Servo Delden B.V.) | 0.075 g/m² |
| mixture of monolauryl and dilauryl phosphate (Servoxyl ™ VPAZ 100 from Servo Delden B.V.): | 0.075 g/m² |
| talc (MICROACE type P3 from Nippon Talc) | 0.045 g/m² |

-continued

| | |
|---|---|
| glycerine monotallow acid ester (Rilanit ™ GMS from Henkel AG): | 0.15 g/m² |
| tetramethylorthosilicate hydrolyzed in the presence of methanesulfonic acid: | 0.87 g/m² |

The pH of the coating composition was adjusted to a pH of 4 by adding 1N nitric acid. Those lubricants which were insoluble in water, were dispersed in a ball mill with, if necessary, the aid of a dispersion agent. The composition was coated to a wet layer thickness of 85 μm and then dried at 40° C. for 15 minutes and hardened for 7 days at 45° C. and a relative humidity of 70% thereby producing the thermographic recording materials of COMPARATIVE EXAMPLES 1 to 3 and INVENTION EXAMPLES 1 to 3.

Thermographic Printing

The thermographic recording materials of COMPARATIVE EXAMPLES 1 to 3 and INVENTION EXAMPLES 1 to 3 were printed using a DRYSTAR® 2000 printer from AGFA-GEVAERT equipped with a thin film thermal head with a resolution of 300 dpi adapted to operate with a line time of 12 ms and a maximum printing power of 82 mW/pixel (the line time being the time needed for printing one line). During this line time the print head received constant power. The thermal head resistors were power-modulated to produce different image densities.

The maximum densities of the images ($D_{max}$) measured through a visible filter with a MACBETH™ TR924 densitometer in the grey scale step corresponding to a data level of 64 are given in Table 2 for COMPARATIVE EXAMPLES 1 to 3 and INVENTION EXAMPLES 1 to 3.

TABLE 2

| | Reducing agent | AgB coverage [g/m²] | printer settings: 300 dpi/12 ms/34 mW $D_{max}$ | coverage ratio = $D_{max}$/AgB |
|---|---|---|---|---|
| Invention Example nr | | | | |
| 1 | R01 | 3.29 | 2.82 | 0.86 |
| 2 | R07 | 4.13 | 3.24 | 0.78 |
| 3 | R21 | 3.58 | 2.99 | 0.83 |
| Comparative Example nr | | | | |
| 1 | CR01 | 4.68 | 3.01 | 0.64 |

TABLE 2-continued

| | Reducing agent | AgB coverage [g/m²] | printer settings: 300 dpi/12 ms/34 mW $D_{max}$ | coverage ratio = $D_{max}$/AgB |
|---|---|---|---|---|
| 2 | CR02 | 3.42 | 1.80 | 0.53 |
| 3 | CR03 | 3.42 | 2.01 | 0.59 |

It is clear from Table 2, that prints obtained with the thermographic recording materials of INVENTION EXAMPLES 1 to 3, with reducing agents R01, R07 and R21 respectively, had significantly higher $D_{max}$/AgB coverage ratios (0.78 to 0.86) i.e. exhibited better thermal developability than prints obtained with the thermographic recording materials of COMPARATIVE EXAMPLES 1 to 3, with reducing agents CR01 to CR03 (0.53 to 0.64).

Archivability Tests

Simulated long-term archivability tests were performed by heating prints produced with the thermographic recording materials of COMPARATIVE EXAMPLES 1 to 3 and INVENTION EXAMPLES 1 to 3 to heating at 57° C. in 34% relative humidity for 3 days and 45° C. in 70% relative humidity in the dark for 4 days respectively and the changes in density with respect to the fresh prints were monitored for an initial density of 1.0 and are summarized in Table 3.

TABLE 3

| | Reducing gent | coverage ratio $D_{max}$/AgB | Change on heating in dark for 3d/57° C./34% RH ΔD for D = 1.0 | Change on heating in dark for 4d/45° C./70% RH ΔD for D = 1.0 |
|---|---|---|---|---|
| Invention Example nr. | | | | |
| 1 | R01 | 0.86 | +0.12 | +0.16 |
| 2 | R07 | 0.78 | +0.14 | 0.00 |
| 3 | R21 | 0.83 | +0.35 | +0.13 |
| Comparative Example nr. | | | | |
| 1 | CR01 | 0.64 | +0.50 | +0.23 |
| 2 | CR02 | 0.53 | +0.11 | +0.05 |
| 3 | CR03 | 0.59 | +0.10 | +0.06 |

It is clear from the results of table 3 that despite the improvement in thermal developability as expressed by the coverage ratio $D_{max}$/AgB, no significant deterioration could be observed in the archivability behaviour of the thermographic recording materials of INVENTION EXAMPLES 1 to 3 compared with those of the thermographic recording materials of COMPARATIVE EXAMPLES 1 to 3.

Having described in detail preferred embodiments of the current invention, it will now be apparent to those skilled in the art that numerous modifications can be made therein without departing from the scope of the invention as defined in the following claims.

We claim:

1. A monosheet black and white substantially light-insensitive thermographic recording material comprising a thermosensitive element and a support, said thermosensitive element containing a substantially light-insensitive organic silver salt, a 1,2-dihydroxyphenyl-compound in thermal working relationship therewith and a binder, wherein said 1,2-dihydroxyphenyl-compound is represented by formula (I): $R^1SO_2R^2$, wherein $R^1$ is an optionally substituted aryl group and $R^2$ is selected from the group consisting of a 3,4,5-trihydroxyphenyl group, a 3-alkoxy-4,5-dihydroxyphenyl group and a 3-aryloxy-4,5-dihydroxyphenyl group; or said 1,2-dihydroxyphenyl-compound is represented by formula (II): $R^3COOR^4$, wherein $R^3$ is a 3-alkoxy-4,5-dihydroxyphenyl group or a 3-aryloxy-4,5-dihydroxyphenyl group; $R^4$ is an alkyl group or an aryl group.

2. Thermographic recording material according to claim 1, wherein said thermosensitive element further comprises a reducing agent selected from the group consisting of 3,4-dihydroxybenzoate alkyl and aryl esters, 3,4-dihydroxybenzophenone, 3,4-dihydroxy-acetophenone and 3,4-dihydroxybenzonitrile.

3. Thermographic recording material according to claim 1, wherein said thermosensitive element further comprises one or more toning agents selected from the group consisting of phthalazinone, benzo[e][1,3]oxazine-2,4-dione, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

4. Thermographic recording material according to claim 1, wherein said thermosensitive element further comprises at least one optionally substituted aliphatic polycarboxylic acid and/or anhydride thereof in a molar percentage of at least 15 with respect to all the organic silver salt(s) present and in thermal working relationship therewith.

5. Thermographic recording material according to claim 4, wherein said optionally substituted aliphatic polycarboxylic acid and/or anhydride is glutaric acid.

6. Thermographic recording material according to claim 1, wherein said organic silver salt is not a double salt.

7. Thermographic recording material according to claim 1, wherein said thermosensitive element is provided with a protective layer.

8. A thermographic recording process for a monosheet black and white substantially light-insensitive thermographic recording material, said light-insensitive thermographic recording material comprising a thermosensitive element and a support, said thermosensitive element containing a substantially light-insensitive organic silver salt, a 1,2-dihydroxyphenyl-compound in thermal working relationship therewith and a binder, wherein said 1,2-dihydroxyphenyl-compound is represented by formula (I): $R^1SO_2R^2$, wherein $R^1$ is an optionally substituted aryl group and $R^2$ is selected from the group consisting of a 3,4,5-trihydroxyphenyl group, a 3-alkoxy-4,5-dihydroxyphenyl group and a 3-aryloxy-4,5-dihydroxyphenyl group; or said 1,2-dihydroxyphenyl-compound is represented by formula (II): $R^3COOR^4$, wherein $R^3$ is a 3-alkoxy-4,5-dihydroxyphenyl group or a 3-aryloxy-4,5-dihydroxyphenyl group; $R^4$ is an alkyl group or an aryl group, comprising the steps of: (i) providing said thermographic recording material; (ii) bringing said thermographic recording material into the proximity of a heat source; (iii) applying heat imagewise from said heat source to said thermographic recording material; and (iv) removing said thermographic recording material from the proximity of said heat source.

* * * * *